US005339494A

United States Patent [19]

Esau et al.

[11] Patent Number: 5,339,494

[45] Date of Patent: Aug. 23, 1994

[54] VEHICLE HOOD WITH HINGE

[75] Inventors: Dierk Esau, Heidelberg; Sinan Hosgoer, Worms, both of Fed. Rep. of Germany

[73] Assignee: Deere & Company, Moline, Ill.

[21] Appl. No.: 13,886

[22] Filed: Feb. 4, 1993

[30] Foreign Application Priority Data

Feb. 11, 1992 [DE] Fed. Rep. of Germany ..... 4203871

[51] Int. Cl.[5] ..... E05F 1/08; E05F 9/00; E05F 11/00

[52] U.S. Cl. ..... 16/294; 16/302; 16/233; 16/374

[58] Field of Search ..... 16/233, 286–289, 16/291, 293, 294, 302, 374

[56] References Cited

U.S. PATENT DOCUMENTS

| | | | |
|---|---|---|---|
| 2,185,214 | 1/1940 | Claud-Mantle | 16/288 |
| 2,629,883 | 3/1953 | Nowell | 16/302 |
| 2,634,455 | 4/1953 | Fish | 16/288 |
| 2,740,155 | 4/1956 | Hammond | 16/288 |
| 2,840,847 | 7/1958 | Danser | 16/288 |
| 2,956,303 | 10/1960 | Fiedler | 16/288 |
| 3,039,557 | 6/1962 | Boyce et al. | 16/289 |
| 4,125,170 | 11/1978 | Botz | 16/287 |
| 4,223,420 | 9/1980 | Yukimoto et al. . | |
| 4,679,841 | 7/1987 | Taunay | 16/288 |
| 4,773,126 | 9/1988 | Voss | 16/294 |
| 4,853,985 | 8/1989 | Perry | 16/291 |
| 4,894,884 | 1/1990 | Lautenschlager, Jr. | 16/294 |

FOREIGN PATENT DOCUMENTS

| | | | |
|---|---|---|---|
| 915781 | 7/1954 | Fed. Rep. of Germany . | |
| 2313949 | 10/1974 | Fed. Rep. of Germany . | |
| 786431 | 11/1957 | United Kingdom | 16/DIG. 1 |
| 931284 | 7/1963 | United Kingdom . | |

*Primary Examiner*—Lowell A. Larson
*Assistant Examiner*—Donald M. Gurley

[57] ABSTRACT

The hinge for the hood of an agricultural tractor includes a reversing plate pivotally mounted on the vehicle body. A first hinge arm has one end coupled to the reversing plate and a second end coupled to the hood. A second hinge arm has one end coupled to the vehicle body and a second end coupled to the hood. The reversing plate is rotated by a manually-operated lever mechanism. A lock mechanism near a front end of the hood retains the hood in a closed position and releases the hood only after a first opening phase, after which the hood can be fully opened during a second opening phase. A gas spring is coupled between the vehicle body and the reversing plate. In the closed position the gas spring helps to hold the hood in the closed position. The gas spring helps to open the hood after the reversing plate is rotated by a certain amount beyond a neutral position.

10 Claims, 5 Drawing Sheets

VEHICLE HOOD WITH HINGE

BACKGROUND OF THE INVENTION

The invention relates to a vehicle hood with a hinge with at least one hinge arm, one end of which is connected through a joint to the vehicle body and the other end is connected through a joint to the hood.

A known hinge for a hood is described in U.S. Pat. No. 4,223,420, issued to Yukimoto et al. on Sep. 23, 1980. In this known hinge a first arm is connected to the hood and at its first end is connected in a joint to a first connecting link by means of a pin. The other end of the first connecting link is connected to a second arm in a joint by means of a pin which is attached to a vehicle body. A second connecting link is similarly connected in joints between the first arm and the second arm without crossing the first connecting link. An extension spring is stretched between the end of the first arm and the joint connecting the second connecting link with the second arm. The spring is biased to bring the first arm and with it the hood from the closed position to the open position.

The known hood can be opened by the operator pushing the hood upward, away from the vehicle body. The opening movement of the hood is controlled by the four-bar linkage consisting of the two arms and the two connecting links. It would be desirable to have a hood with hinge of the aforementioned type, which can be manually-operated and which has an automatic locking arrangement which interacts with the opening mechanism at the end of the hood opposite the hinge.

SUMMARY OF THE INVENTION

Accordingly, an object of this invention is to provide a hinge of the aforementioned type, which can be manually-operated and which has an automatic locking arrangement which interacts with the opening mechanism at the end of the hood opposite the hinge.

Another object of this invention is to provide a means by which the degree of opening of the hood can be limited.

These and other objects are achieved by the present invention wherein a hood hinge is located in the rear region in the vicinity of the cab of an agricultural tractor. The hinge includes a reversing plate pivotally mounted on the vehicle body. A first hinge arm has one end coupled to the reversing plate and a second end coupled to the hood. A second hinge arm has one end coupled to the vehicle body and a second end coupled to the hood. The reversing plate is rotated by a manually-operated lever mechanism. A lock mechanism near a front end of the hood retains the hood in a closed position and releases the hood only after a first opening phase, after which the hood can be fully opened during a second opening phase. A latch member releasably holds the reversing plate in its closed position. A gas spring is coupled between the vehicle body and the reversing plate. In the closed position the gas spring helps to hold the hood in the closed position. The gas spring helps to open the hood after the reversing plate is rotated by a certain amount beyond a neutral position.

During a primary opening phase the rear end of the hood is lifted and simultaneously moved horizontally forward. During a secondary opening phase the front end of the hood is fully lifted as the hood pivots about a pivot axis which is generally at the location of the hinge. The rear end of the hood follows a path which avoids any collision with any components of the tractor cab.

Further advantageous embodiments and further developments of the invention follow from the subordinate claims.

DETAILED DESCRIPTION

A box-shaped vehicle body 10 encloses the engine compartment of an agricultural vehicle (not shown), such as an agricultural tractor. A hinge assembly, along with an associated actuating mechanism, is mounted on each side of the rear end of the vehicle body 10, only one of which is shown. In its forward region the vehicle body 10 carries a lock mechanism 12 on each side. The engine compartment is covered from above by a hood 14. In the following description only one of the two hinge assemblies and locking mechanisms 12 will be described.

Figure 3:
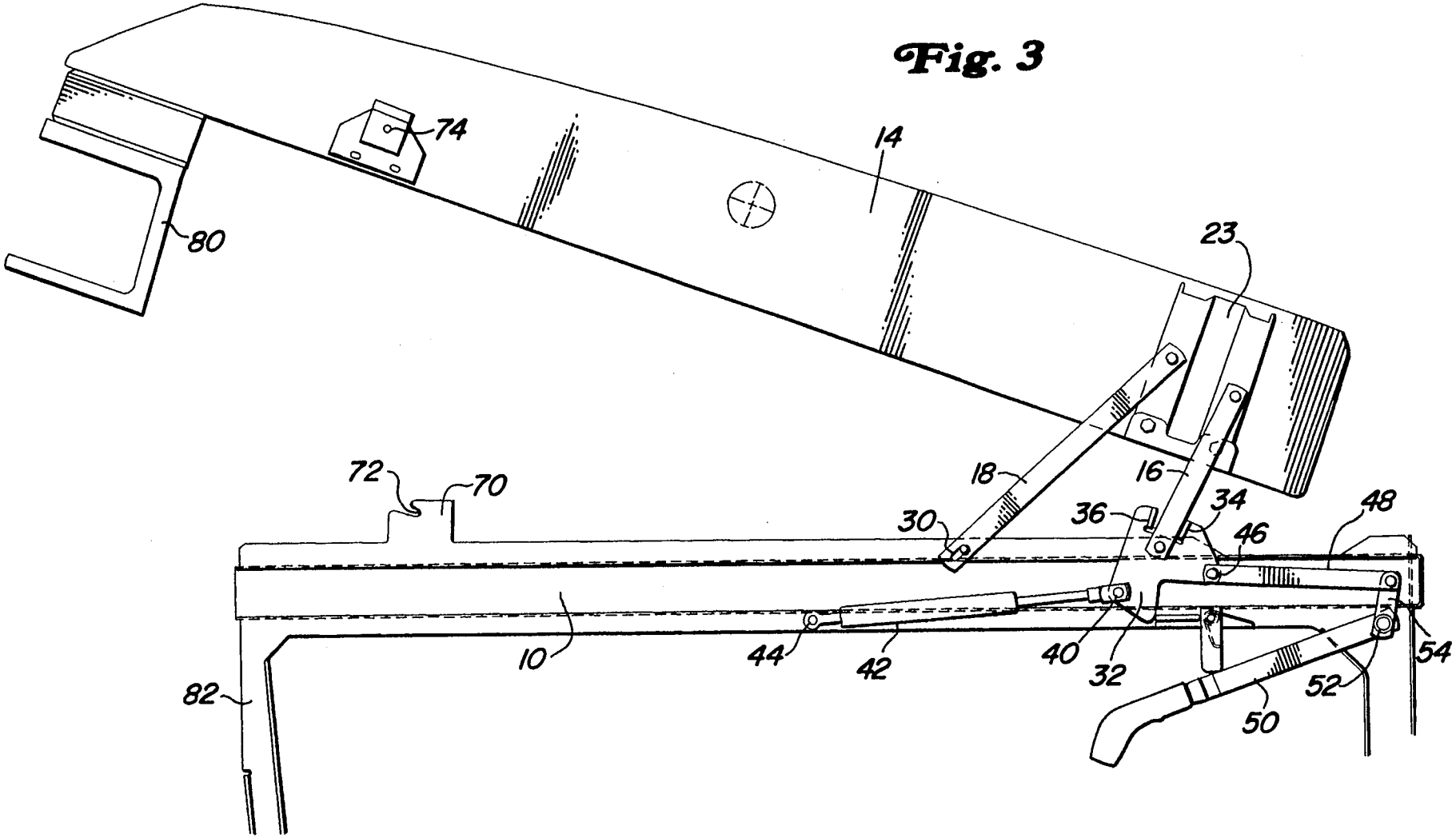
FIG. 3 is a side view similar to that of FIG. 1 which shows the hood in a half-open erect position.

The rear end of the hood 14 is connected by a first and a second hinge arm 16, 18 to the vehicle body 10 so as to pivot. The joints are formed by a rear bearing pin 20, fixed in the hood, and a front bearing pin 22, fixed in the hood, that are attached to a transverse reinforcement 23 of the hood 14, as well as a bearing pin 24, fixed in the vehicle, and a front bearing pin 26, fixed in the vehicle. The bearing pins 20, 22 and 24 engage bores in the end regions of the strap-shaped hinge arms 16, 18. The front bearing pin 26, fixed in the vehicle, extends through an elongated hole 30 that extends in the direction the hinge arm in the forward lower end of the second hinge arm 18. The hinge arms 16, 18 interact with the vehicle body 10 and the hood 14 to form a four-bar linkage. Since the first rear hinge arm 16 is shorter than the second front hinge arm 18, an opening movement of the hood 14 results from the pivoting of the hinge arms 16, 18 in counterclockwise direction, in which the forward end of the hood is raised away from the vehicle body 10, as is shown in FIG. 3.

Because hinge arm 18 is slidably coupled to the vehicle body by pin 26, and is pivotally coupled to the hood 14, the hinge arms 16 and 18 cooperate together as a four-bar linkage, after reaching a predetermined limit, so that the hood 14 is shifted generally parallel to the vehicle body 10 upon pivoting of the first hinge arm 16 up to the predetermined limit, and becomes fully opened upon further pivoting of the first hinge arm 16. Preferably, the elongated hole 30 is dimensioned so that the pin 26 engages the end of the hole 30 only after the pivoting of the hinge arms has completed a first opening phase of the hood 14.

A reversing plate 32 pivots on the rear bearing pin 24, which is fixed on the vehicle. The reversing plate 32 carries two brackets bent out of the side plane which form stops 34, 36 which engage the first hinge arm 16 between them. The inside distance between the stops 34, 36 is larger than the corresponding width of the first hinge arm 16, so that a clearance 38 exists between the first hinge arm 16 and at least one of the stop 34, 36. When the reversing plate 32 is rotated about pin 24 one of the two stops is forced against the first hinge arm 16 and swings the latter.

Figure 5:
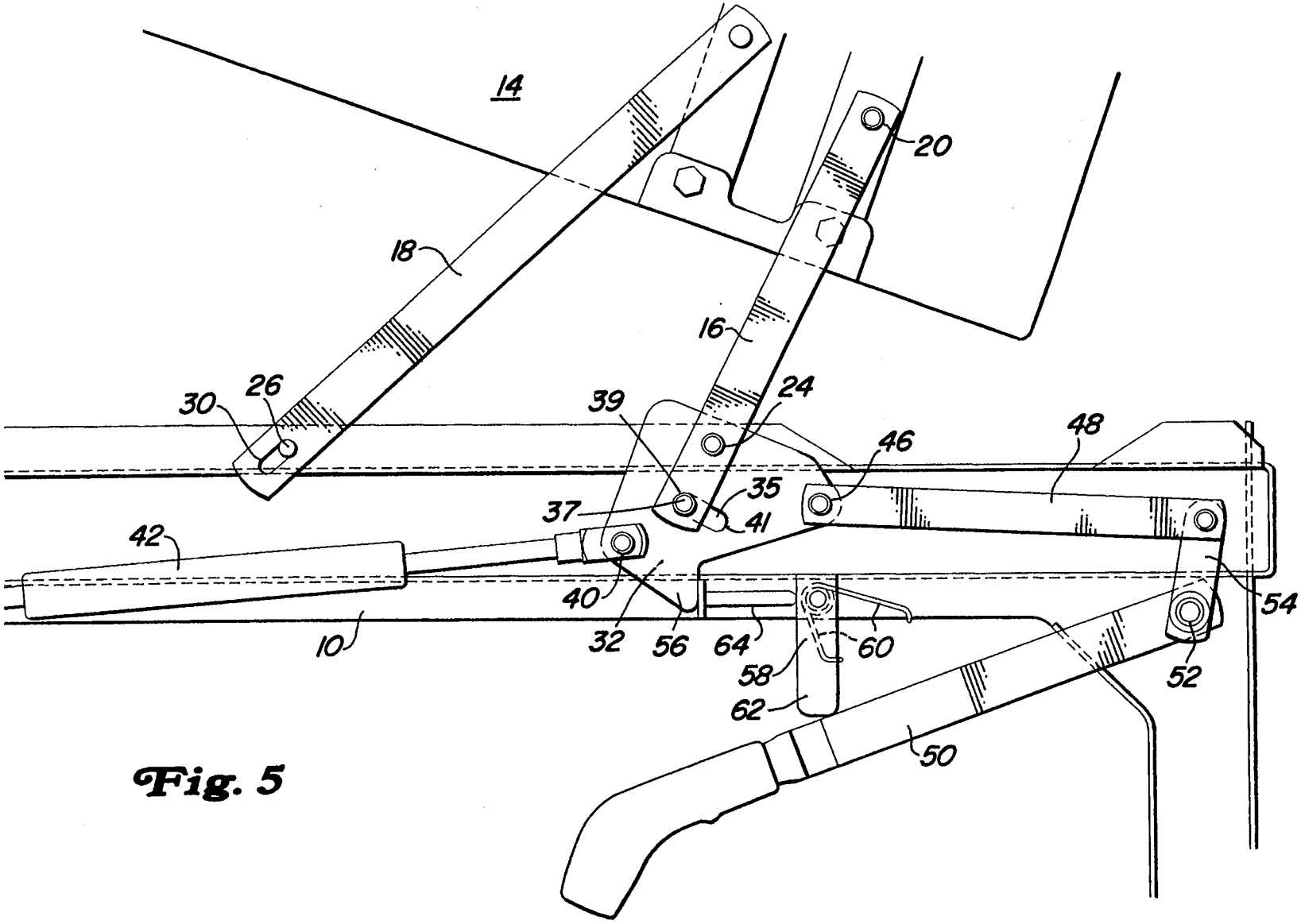
FIG. 5 is an enlarged view similar to that of FIG. 4, but showing an alternative stop arrangement of the hinge arm.

An alternative to the stops 34, 36 is shown in FIG. 5, wherein the reversing plate 32 is provided with an elongated hole 35 which engages a pin 37 fastened to the first hinge arm 16. When the first hinge arm 16 is pivoted, the pin 37 makes contact with one of the ends 39, 41 of the elongated hole 35 and thereby limits the path of pivoting motion. The hinge arm 16 and the reversing plate 32 could be configured as a one-piece component. However, preferably the reversing plate 32 is a separate part and is provided with stops as described above.

The piston end of a gas spring 42, operating as a compression spring, is coupled at point 40 to the reversing plate 32, which is spaced away from the joint 24. The cylinder end of the gas spring 42 is pivotally coupled at a joint 44 to the vehicle body 10. The relative location of the joint 24 and the point of force application 40 is selected so that in the neutral position of the reversing plate 32 both points 24, 40 are in alignment with the line of force application of the gas spring 42. The reversing plate 32 reaches its neutral position approximately at the point at which the hood is closed and the stop 34 touches the hinge arm 16. The gas spring 42 urges the hinge arm 16 in an opening or closing direction depending upon its exceeding or underrunning the neutral position. If the hood 14 and the hinge arm 16 are below the neutral position, then the force of the gas spring 42 operates in a direction to close the hood 14. The hood 14 is thus retained in the closed position despite shocks and other applied forces. If the hood 14 and the hinge arm 16 are above the neutral position, then the force of the gas spring 42 assists in the opening of the hood 14. With an appropriate design of the gas spring 42, the hood 14 can open automatically, at least partially, after crossing the neutral position, without the need for any additional force application. Preferably the gas spring 42 is designed so that it supports the aforementioned primary opening phase of the hood 14, in which a force must be applied to lift the rear end of the hood 14. The hood 14 may be fully opened by manually lifting of the forward end of the hood 14, according to the secondary opening phase. If the hood is fully opened, the gas spring 42 retains the hood in this position.

A connecting link 48 of a manually operated lever mechanism is coupled at connecting point 46 to the reversing plate 32. The position of the joint 24, the engagement point 40 and the connecting point 46 are selected in such a way that they form the corners of an approximate isosceles right triangle. The lever mechanism contains a handgrip 50 which is rotatably supported on the vehicle body 10 by transverse shaft 52. A short lever 54 is fixed to and extends at an angle with respect to the handgrip 50. A lever 54 and handgrip 50 are pivotally supported on the transverse shaft 52 on each side of the hood. Each lever 54 is pivotally coupled to a corresponding connecting link 48. The drawing shows only one of these levers 54 with the associated hinge.

Figure 4:
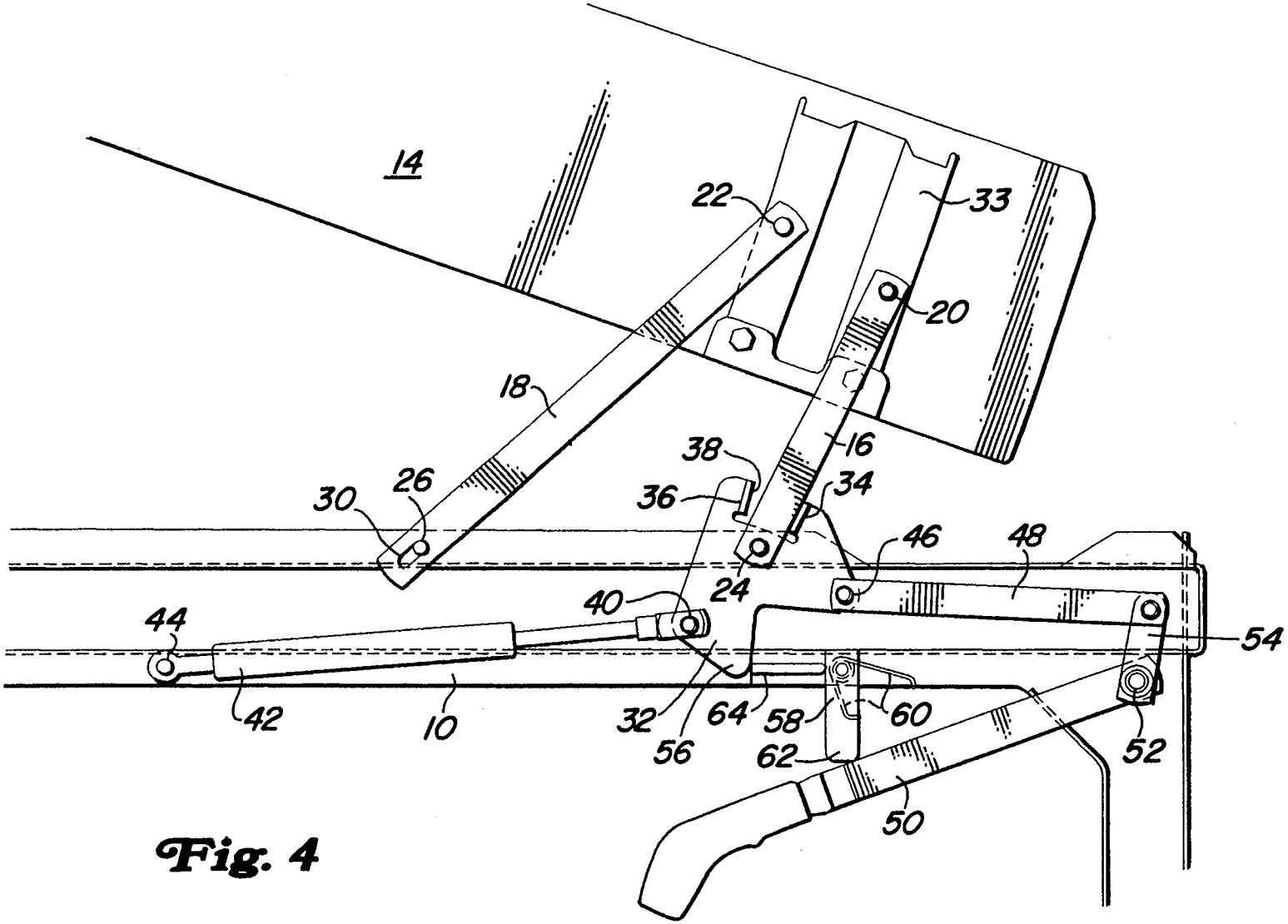
FIG. 4 is an enlarged view of the hinge region of FIG. 3.

As best seen in FIGS. 4 and 5, the reversing plate 32 is provided with a projection 56 which acts as a stop which engages a L-shaped latch 58 which includes legs 62 and 64. The latch 58 is pivotally supported on the vehicle body 10, and a torsion spring 60, preferably a helical spring with two lugs, is biased to urge the latch 58 to the illustrated locking position. When the downward-pointing leg 62 of the latch 58 is pushed towards the rear of the vehicle, the latch 58 can be rotated until its other leg 64 moves out of the latching position. The latch 58 operates to limit the opening movement of the hood 14. Normally, the latch 58 can remain in its locked position, so that the hood 14 can be opened only partially. In case the hood 14 is to be fully opened the latch 58 can be rotated out of engagement with the reversing plate 32.

The locking mechanism 12 at the forward end of the hood includes a mount 70 attached to the vehicle body 10. Mount 70 includes a hold-down slot 72 which opens to the front and away from the hinge. The slot releasably receives a hold-down pin 74 oriented transverse to the direction of travel is fastened to the hood 14. Alternatively, the pin 74 could be fastened to the vehicle body 10 for receipt by a slot formed in the hood 14 which is open in the direction of the hinge.

When the hood 14 is closed, the hold-down pin 74 is received by the hold-down slot 72. With the use of such a lock arrangement the hood 14 can be locked at the front and at the hinge, by engaging the reversing plate 32 with member 64.

To actuate the reversing plate 32 it is necessary to operate only the handgrip 50. If the hood 14 is to be locked because of the danger of theft or vandalism, the components can be located behind a locked door (not shown).

MODE OF OPERATION

The operation of opening and closing the hood 14 is as follows will now be described with respect to the hinge and locking mechanism on one side of the hood 14.

Figure 1:
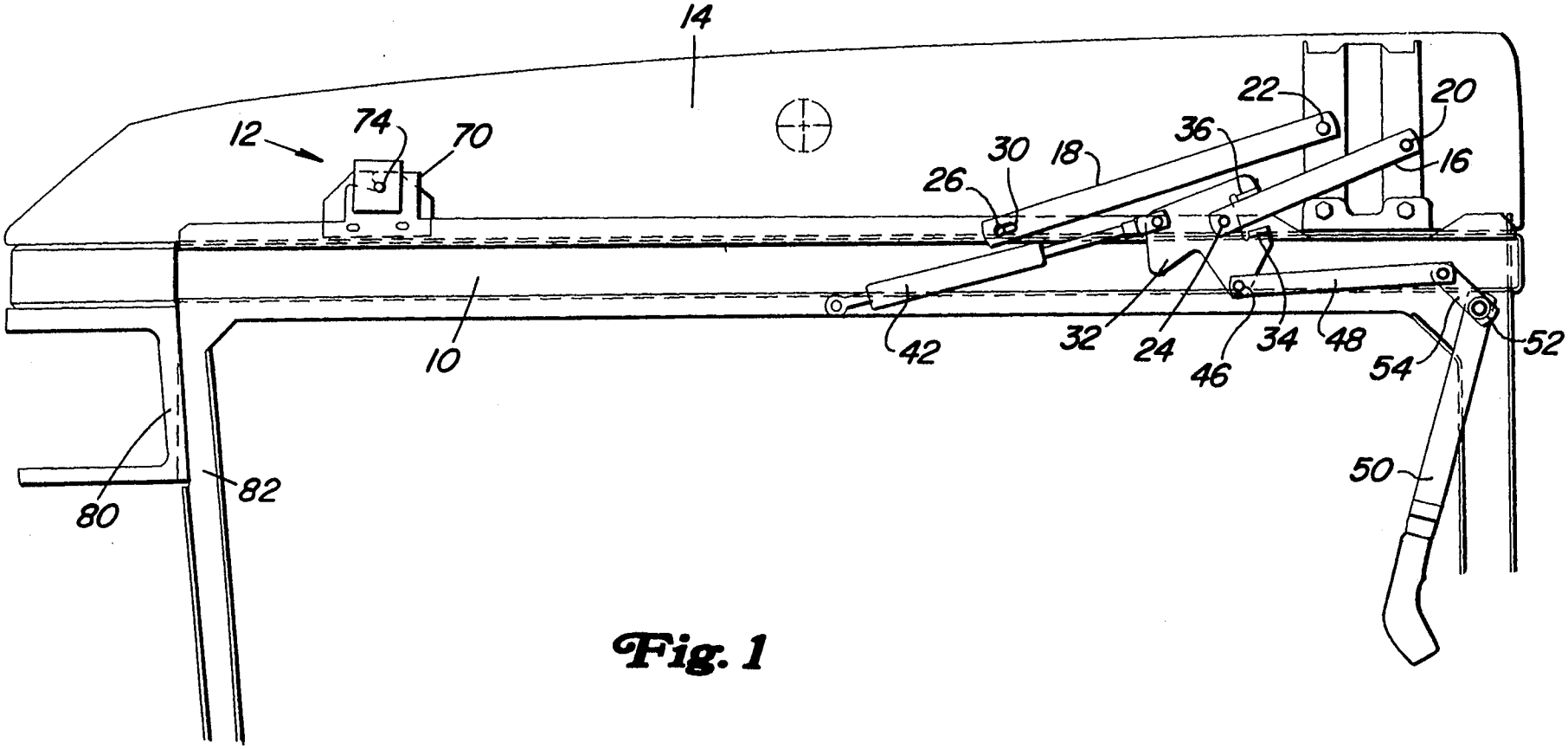
FIG. 1 is a side view of a hood connected to a vehicle body by a hinge, according to the invention, in closed position.

In the closed position shown in FIG. 1, the force of the gas spring 42 is applied through the upper stop 36 of the reversing plate 32 on the first hinge arm 16 and forces the latter downward. The force applied by the hinge arm 16 to the bearing pin 20 closes the hood 14. At the front the hood is locked by the hold-down pin 74 retained in the hold-down slot 72. The handgrip 50 is in its rear position with respect to the direction of travel.

To unlatch and open the hood the handgrip 50 is pushed forward. This pulls the connecting link 48 rearward and the reversing plate 32 is rotated in a counterclockwise direction, whereby the gas spring 42 is initially compressed against its spring force. After being compressed, the gas spring 42 then again extends and assists the further supports the further counterclockwise rotation of the reversing plate 32.

Figure 2:
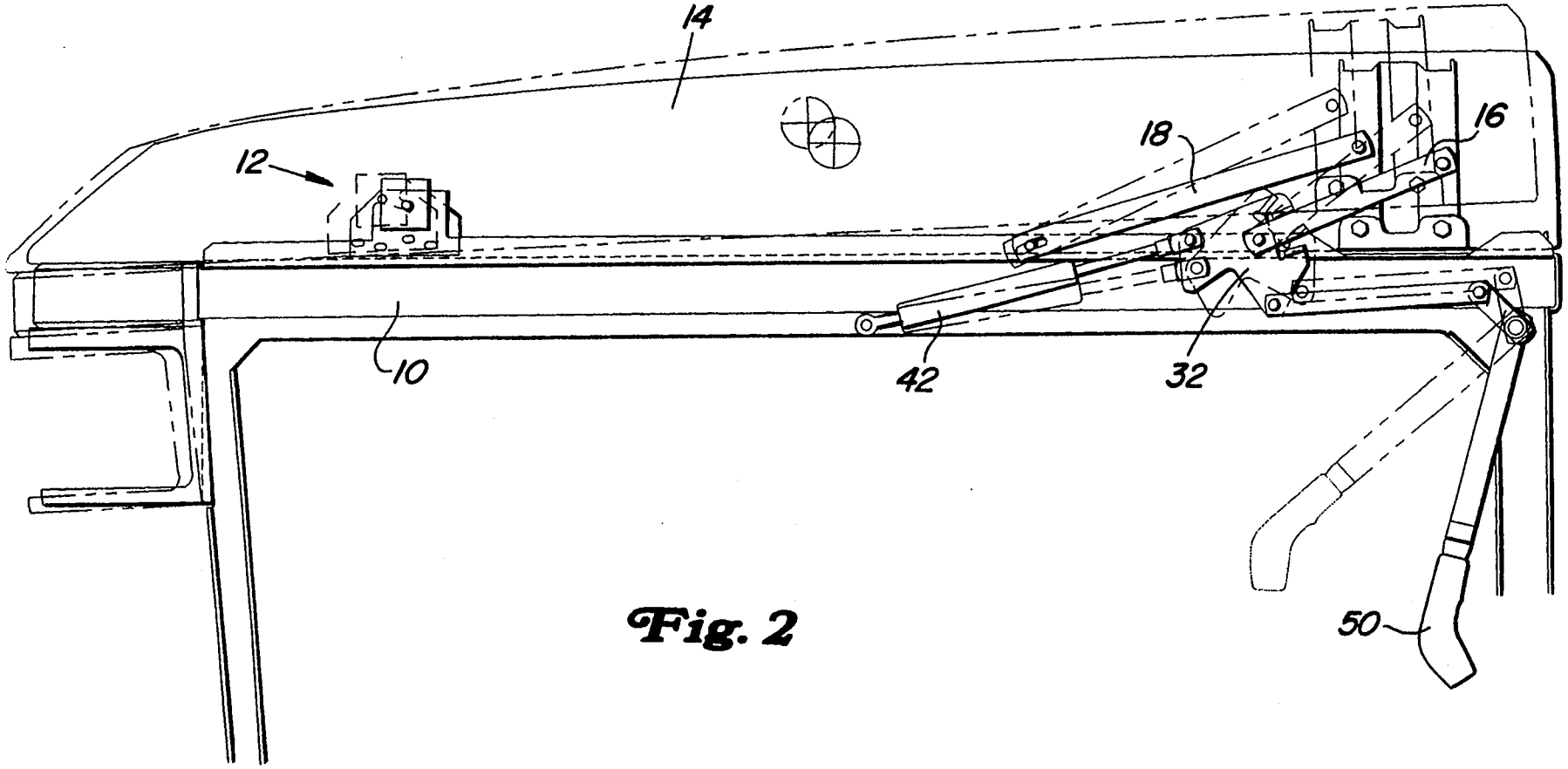
FIG. 2 is a side view similar to that of FIG. 1 which shows the hood with its hinge in its closed position and in a primary opening phase position.

The first hinge arm 16 and the hood 14 remain in the closed position until the lower stop 34 of the reversing plate 32 engages the lower side of the first hinge arm 16. Further counterclockwise rotation of the reversing plate 32 causes the first hinge arm 16 to rotate in a counterclockwise direction and this raises the rear end of the hood 14 to the position illustrated by the dashed lines in FIG. 2.

During the unlatching operation described so far, the second hinge arm 18 merely slides forward and slightly downward with respect to the fixed front bearing pin 26. The hood 14 reaches a stable and controlled position when the rear end of the hole 30 engages the bearing pin 26, as best seen in FIG. 4. The forward movement of the hood 14 retracts the hold-down pin 74 from the hold-down slot 72, so that the forward end of the hood 14 is free, while still in contact with the vehicle body 10.

During the primary opening phase the hood 14 is raised at its rear end, and simultaneously moved forward horizontally at its front end. This simplifies the design of the sealing surface between the front grill cover 80, attached to the hood 14, and the side enclosure components 82 of the vehicle body 10.

During the secondary opening phase the mechanism operates as a conventional four-bar linkage, since the second hinge arm 18 is now supported on the fixed bearing pin 26.

In order to open the hood 14 further, after it has been unlatched, it is lifted at the front. The first hinge arm 16 and the second hinge arm 18 pivot about the bearing pins 20, 22, 24, 26. The upper end of hole 30 acts as lower pivot point for the second hinge arm 18, since the weight of the hood 14 continues to support the second hinge arm 18 at its forward, lower end.

The lower stop 34 of the reversing plate 32 engages the first hinge arm 16 so that the reversing plate 32 operates kinematically as a component of the first hinge arm 16. The gas spring 42 assists in the opening of the hood 14, so that after passing through its position of maximum compression, the hood 14 swings upward automatically. During the secondary opening phase the rear region of the hood 14 follows a path which prevents any collision with the windshield of the tractor cab (not shown).

When the hood 14 is lowered it can be locked in three ways:

1. Swinging the handgrip 50 downward and to the rear, whereby the process described for the primary opening phase is reversed,
2. Depressing the rear end of the hood 14, or
3. Pressing the front end of the hood to the rear.

In each of these cases the original locked condition is reached.

In the primary opening phase the hood 14 is guided only by the first hinge arm 16 as well as the front hold-down pin 74 and the hold-down slot 72, and the second hinge arm 18 remains inactive, however, during the secondary opening phase the hood 14 is guided only by the first and the second hinge arm 16, 18.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

We claim:

1. A hinge for a hood, the hinge having at least one hinge arm, the at least one hinge arm having one end pivotally coupled to the vehicle body and having another end pivotally coupled to the hood, characterized by:

a reversing plate pivotally coupled to the vehicle body by a first pivot pin and pivotally coupled to the at least one hinge arm by said first pivot pin means on, the reversing plate permitting relative pivotal motion between said reversing plate and said at least one hinge arm about said first pivot pin through a limited range from a neutral position to an open position and to a closed position;

an energy storage device coupled to the vehicle body and coupled to the reversing plate by a second pivot pin spaced apart from the first pivot pin, the energy storage device being biased to hold the reversing plate in the open position when an axis of the energy storage device is on one side of the first pivot pin and in the closed position when an axis of the energy storage device is on another side of the first pivot pin, movement of the reversing plate to its open position causing the at least one hinge arm and the hood to move to an open position, and movement of the reversing plate to its closed position causing the at least one hinge arm and the hood to move to a closed position; and a manually-operated lever mechanism coupled to the reversing plate, the lever mechanism being operable to rotate the reversing plate about the first pivot pin to the neutral position against the bias of the energy storage device.

2. The hinge of claim 1, characterized by:

the first pivot pin is fixed to the vehicle body;

said means comprises a pair of stops which are engagable with the at least one hinge arm to limit relative motion between the reversing plate and the at least one hinge arm; and the energy storage device comprises a gas spring which is coupled to the reversing plate by the second pivot pin, the gas spring being aligned with the first pivot pin when the reversing plate in the neutral position.

3. The hinge of claim 1, wherein:

said means comprises a pair of stops which are engagable with the at least one hinge arm to limit relative motion between the reversing plate and the at least one hinge arm.

4. The hinge of claim 3, wherein:

a clearance is provided between the at least one hinge arm and the stops to permit a small relative rotation between the at least one hinge arm and the reversing plate.

5. The hinge of claim 1, wherein:

said means comprises an elongated hole formed in the reversing plate, the hole receiving a pin fixed to the at least one hinge arm, the hole and the pin cooperating to limit relative motion between the reversing plate and the at least one hinge arm.

6. The hinge of claim 1, wherein:

the reversing plate has a stop projecting therefrom; and a latch is engagable with the stop to limit rotation of the reversing plate.

7. The hinge of claim 1, wherein:

a second hinge arm has a first end coupled to the vehicle body by a first pin and a second end coupled to the hood by a second pin, one of the ends having a slot therein which slidably receives the corresponding pin, and the second hinge arm and the first hinge arm cooperating together as a four-bar linkage so that the hood moves generally parallel to the vehicle body upon pivoting of the first hinge arm by a certain amount during a first opening phase and so that the hood is fully opened upon further pivoting of the first hinge arm during a second opening phase.

8. The hinge of claim 7, wherein:

an elongated hole is formed in an end of the second hinge arm, the elongated hole slidably receiving a corresponding one of the first and second pins, the elongated hole being dimensioned so the corresponding pin engages an end of the elongated hole at an end of the first opening phase.

9. The hinge of claim 7, wherein:

a lock is mounted on the hood spaced apart from the hinge, the lock operating to retain the hood in its closed position with respect to the vehicle body, and the lock operating to release the hood after the first opening phase.

10. The hinge of claim 9, wherein the lock comprises:

a locking pin fixed to the hood; and a slot formed on the vehicle body for releasably receiving the locking pin, the slot opening in a direction facing away from the hinge.

* * * * *